United States Patent [19]

King

[11] 4,109,687

[45] Aug. 29, 1978

[54] VEHICLE ASSEMBLY-LINE FUELING EMISSION CONTROL METHOD

[75] Inventor: Jack B. King, Royal Oak, Mich.

[73] Assignee: General Motors Corporation, Detroit, Mich.

[21] Appl. No.: 780,600

[22] Filed: Mar. 24, 1977

[51] Int. Cl.[2] ..... B65B 31/00

[52] U.S. Cl. ..... 141/5; 29/430; 280/5 A

[58] Field of Search ..... 29/430; 141/1, 4, 98, 141/392, 5, 7, 11; 280/5 A; 220/85 VR, 85 VS

[56] References Cited

U.S. PATENT DOCUMENTS

| | | | |
|---|---|---|---|
| 3,926,230 | 12/1975 | Stary | 141/45 |
| 3,946,773 | 3/1976 | Hansel | 141/206 |
| 3,957,025 | 5/1976 | Heath | 220/85 VR |

OTHER PUBLICATIONS

Jack B. King, "New-Tank Fueling Emissions," Feb. 1976.

*Primary Examiner*—Richard E. Aegerter
*Assistant Examiner*—Frederick R. Schmidt
*Attorney, Agent, or Firm*—R. L. Phillips

[57] ABSTRACT

A method of capturing the fuel vapors during the fueling of vehicles on a vehicle assembly line using fuel vapor adsorbing devices destined for usage in the evaporative emission control systems of vehicles on that assembly line.

2 Claims, 3 Drawing Figures

VEHICLE ASSEMBLY-LINE FUELING EMISSION CONTROL METHOD

This invention relates to a vehicle assembly line fueling emission control method and more particularly to such a method using fuel vapor adsorbing devices destined for assembly in vehicles on that assembly line.

On a vehicle assembly line, it is common practice to supply a small quantity of gasoline to the fuel tanks of the vehicles being assembled to enable driving them off at the end of the line. It has been found that during such partial fueling, the volume of the vapor-air mixture displaced from the tank can exceed the volume of the fuel delivered to the tank. This prohibits the use of the well known volume-exchange control method where the displaced vapor-air mixture is directed to the vapor space of the gasoline supply tank servicing the line.

According to the present invention and in lieu of, for example, providing added fueling emission storage capacity on the assembly line for subsequent disposal or uselessly burning off such fueling emissions, the present invention takes advantage of the fuel vapor storage capacity provided for vehicles having an evaporative emission control system.

According to the present invention, the large volume of vapor-air mixture displaced during the fueling of the new fuel tanks on the vehicles on the line is directed into a bank of activated carbon canisters destined for assembly in vehicles on that assembly line, the vapor-air mixture being directed thereto by a vapor recovery type fueling nozzle which is detachably sealingly securable to the fuel tank filler neck. The canisters preferably are arranged in parallel to adsorb the hydrocarbon components and because of their arrangement there is relatively low flow impedence and thus rapid venting of the fuel tanks. The canisters are removed from the bank substantially in advance ot their vapor storage capacity being reached and are installed in vehicles on the line ahead of the fueling operation. The lightly loaded canisters then operate as they normally would in the evaporative emission control system of these vehicles. And since only a small portion of the canisters' vapor storage capacity is utilized during such fueling vapor recovery, such stored fueling emission vapors will be readily desorbed on initial engine operation and will have no effect on the canisters' subsequent normal use in the vehicles.

An object of the present invention is to provide a new and improved vehicle assembly line fueling emission control method.

Another object is to provide a vehicle assembly line fueling emission control method wherein the vapor-air mixture displaced from the fuel tanks during initial fueling is delivered to a plurality of fuel vapor adsorbing devices destined for usage in the evaporative emission control system of vehicles on that assembly line.

These and other objects of the present invention will be more apparent from the following description and drawing in which.

Figure 2:
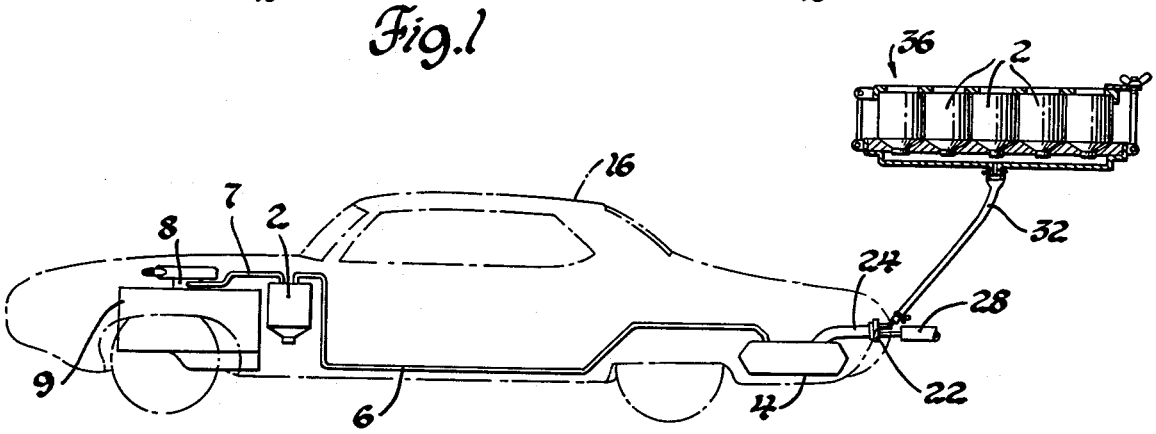
FIG. 2 is a partial schematic and partial sectional view of the fueling station in FIG. 1.

In the assembly of new vehicles having an evaporative emission control wherein a fuel system vapor adsorbing device such as an activated carbon canister 2 is used to capture the hydrocarbon components of the vapor-air mixture venting from the fuel tank, such canisters are normally installed in a new or fresh condition on the assembly line and prior to the partial fueling of the fuel tank. In normal usage, as shown in FIG. 2, the canister 2 adsorbs fuel vapors from the fuel tank 4 through a line 6 and these vapors are released through a line 7 to the induction system 8 of the engine 9 when running. According to the present invention, prior use is made of such canisters to capture the hydrocarbon components of the emissions venting from the fuel tank during the assembly line fueling thereof and these slightly used canisters are installed instead of new or unused ones in the normal sequence on the line ahead of the fueling station.

Figure 1:
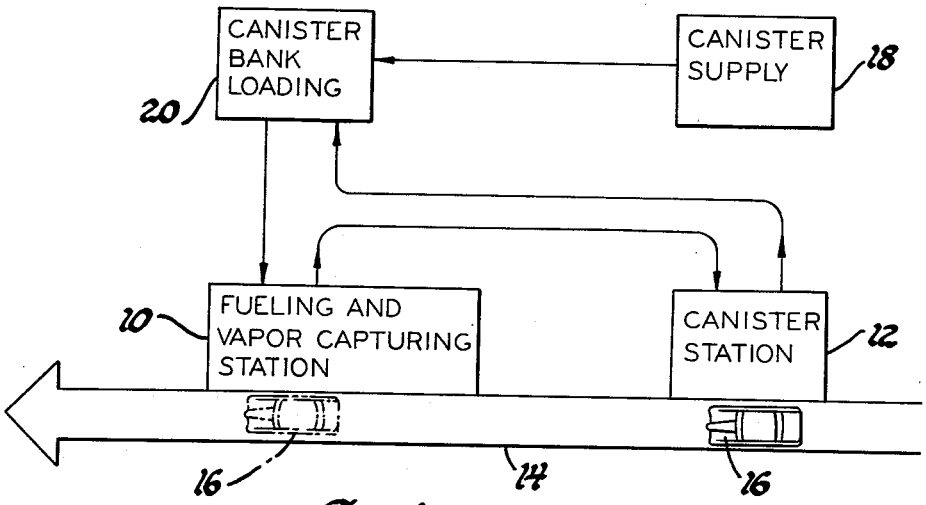
FIG. 1 is a block diagram of the emission control method of the present invention in use on a vehicle assembly line.

Referring to FIG. 1, this new and improved method is accomplished with a fueling and vapor capturing station 10 and a canister station 12 both located on an assembly line 14 on which new cars 16 are being assembled having an evaporative emission control system utilizing the conventional activated carbon canister 2 from a new canister supply 18 which is located off the line. The new canisters are supplied to a canister bank loading area 20 where they are loaded in banks as described in more detail later and delivered to the fueling and vapor capturing station 10. After their use at station 10, the banks containing fueling emissions are delivered to the upstream canister station 12 where the used canisters are assembled in vehicles prior to their arriving at the fueling and vapor capturing station 10. The empty banks are then returned to the canister bank loading area 20 for subsequent loading of new canisters and return to the fueling and vapor capturing station.

Figure 3:
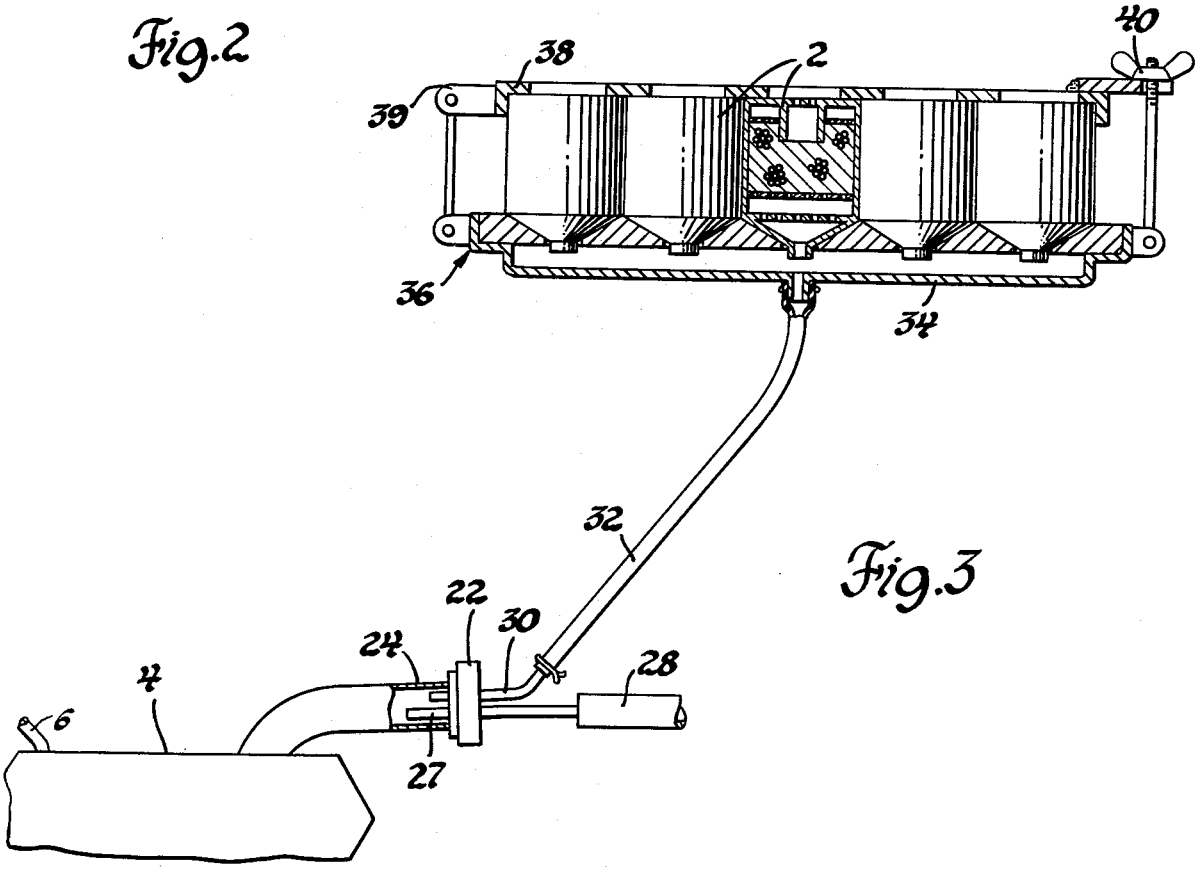
FIG. 3 is an enlarged view of a portion of FIG. 2.

At the fueling and vapor capturing station 10 as shown in FIGS. 2 and 3, there is provided a vapor recovery type fueling nozzle assembly 22 which is sealingly securable to the filler neck 24 of the vehicle's fuel tank 4. The nozzle assembly 22 includes a nozzle 27 with a fuel hose 28 connected thereto through which fuel is delivered in a measured amount. In addition, the nozzle assembly 22 has a vapor outlet pipe 30 for receiving the vapor venting from the fuel tank during such fuel supply and this vapor is conveyed via a vapor hose 32 to a distribution manifold 34 that forms one end of a bank 36 holding the fresh canisters 2, the other side of the bank being contained by a frame 38 which is secured such as by a hinge arrangement 39 and clamp arrangement 40 to the manifold 34 to clamp the canisters in place therebetween. The canisters are arranged side by side in the bank and the manifold 34 is ported so that the canisters are connected in parallel to receive the vapor-air mixture being directed thereto from the fuel tank. Because the canisters are arranged in parallel, there is provided a low flow impedance to accordingly permit rapid venting and thus quick fueling on the line.

The number of fuelings to which the bank of canisters is used is determined so that only a small percentage of their fuel vapor adsorbing capacity is utilized. For example, with a 26-gallon fuel tank having a 2-gallon expansion volume, it has been found that the fueling emission may average about 7 grams per gallon and thus with a typical 3-gallon assembly line fueling, the fueling emissions would amount to about 21 grams. The carbon canister normally used in conjunction with such a fuel tank has a vapor storage capacity of about 160 grams or about eight times the emission from such a 3-gallon fueling. For fueling of the above vehicles the canisters may be exposed to the same number of fuelings that it has canisters so that each canister at the end of its use at the vapor and fueling receiving station would then contain the equivalent of only one fueling emission and thus only one-eighth of the canister's total vapor storage capacity. But, of course, it will be recognized that the exposures could be less or more and that the maximum number is determined by where some substantial adverse effect on subsequent use in the vehicle's evaporative emissions control system would occur.

Describing then the complete method and operation on the assembly line, new canisters 2 from the supply 18 are routed to the canister bank loading area 20 where a preselected number of them are loaded into a bank 36 and delivered to the fueling and vapor capturing station 10. At station 10 and as a new vehicle is passing by, the vapor recovery type fueling nozzle assembly 22 is attached and a predetermined amount of fuel is delivered to the fuel tank. The vehicle has previously had installed therein a used canister from the fueling station 10 but the normal tank vent 6 leading thereto is very restrictive compared to the vapor outlet 30 at the fueling nozzle so practically all the displaced vapor-air mixture leaves the tank via the vapor hose 32 and is delivered to manifold 34 and thus to the fresh canisters in the bank. At the completion of fueling and venting, the nozzle assembly is removed for fueling the next approaching newly assembled vehicle.

After a predetermined number of fuelings which, for example, may equal the number of canisters in the bank as previously discussed, the used bank is then disconnected and a fresh bank of canisters is connected to the manifold for subsequent fuel tank fuelings. The bank of canisters containing the fueling emissions captured at station 10 are delivered ahead on the line of the canister station 12 where these used canisters are then assembled in the evaporative emission control systems of the vehicles approaching the fueling and vapor capturing station. The empty banks are returned to the canister bank loading area 20 for installation of new canisters to repeat the cycle.

The above described embodiment is illustrative of the invention which may be modified within the scope of the claims.

I claim:

1. A method of capturing vapor displaced from fuel tanks in vehicles during fueling on a vehicle assembly line comprising the steps of (1) delivering fuel to the fuel tanks and collecting the vapor-air mixture displaced from the fuel tanks during fuel delivery thereto, (2) delivering the collected vapor-air mixture to a plurality of parallel arranged fuel vapor adsorbing devices destined for usage in fuel vapor collecting systems in vehicles, (3) replacing the fuel vapor adsorbing devices used in step (2) with fresh such devices prior to their reaching their full fuel vapor storage capacity, and (4) installing the fuel vapor adsorbing devices replaced in step (3) in assembly line vehicles prior to delivering fuel to the fuel tanks thereof.

2. A method of capturing vapor displaced from fuel tanks in vehicles during fueling on a vehicle assembly line comprising the steps of (1) delivering fuel to the fuel tanks and collecting the vapor-air mixture displaced from the fuel tanks during fuel delivery thereto, (2) delivering the collected vapor-air mixture to one or more fuel vapor adsorbing devices destined for usage in fuel vapor collecting systems in vehicles, (3) replacing the fuel vapor adsorbing devices used in step (2) with fresh such devices prior to their reaching their full fuel vapor storage capacity, and (4) installing the fuel vapor adsorbing devices replaced in step (3) in assembly line vehicles.

* * * * *